US005227747A

United States Patent [19]

Komazaki et al.

[11] Patent Number: 5,227,747

[45] Date of Patent: Jul. 13, 1993

[54] DIELECTRIC FILTER HAVING COUPLING AMOUNT ADJUSTING PATTERNS

[75] Inventors: Tomokazu Komazaki; Katsuhiko Gunji; Norio Onishi; Osamu Yamato; Akira Mashimo; Kouichi Ichikawa, all of Tokyo, Japan

[73] Assignee: Oki Electric Industry Co., Ltd., Tokyo, Japan

[21] Appl. No.: 892,723

[22] Filed: May 29, 1992

Related U.S. Application Data

[63] Continuation of Ser. No. 655,147, Feb. 14, 1991, abandoned, which is a continuation-in-part of Ser. No. 366,516, Jun. 15, 1989, Pat. No. 5,015,974.

[30] Foreign Application Priority Data

Feb. 14, 1990 [JP] Japan ..... 2-31575

[51] Int. Cl.[5] ..... H01P 1/205

[52] U.S. Cl. ..... 333/206; 333/207

[58] Field of Search ..... 333/202, 206, 207, 222, 333/223

[56] References Cited

U.S. PATENT DOCUMENTS

| | | | |
|---|---|---|---|
| Re. 32,768 | 10/1988 | O'Avello et al. | 333/202 |
| 4,692,726 | 9/1987 | Green et al. | 333/207 X |
| 4,823,098 | 4/1989 | DeMuro et al. | 333/206 |
| 4,965,537 | 10/1990 | Kommrusch | 333/207 X |
| 5,015,974 | 5/1991 | Komazaki et al. | 333/202 |

FOREIGN PATENT DOCUMENTS

| | | | |
|---|---|---|---|
| 0312011 | 4/1989 | European Pat. Off. | 333/202 |
| 0347774 | 12/1989 | European Pat. Off. . | |
| 0239701 | 10/1987 | Japan | 333/202 |
| 0124601 | 5/1988 | Japan | 333/202 |
| 0312701 | 12/1988 | Japan | 333/202 |
| 0075203 | 3/1990 | Japan | 333/202 |
| 2-108302 | 4/1990 | Japan . | |
| 2210225 | 6/1989 | United Kingdom . | |

*Primary Examiner*—Robert J. Pascal
*Assistant Examiner*—Seung Ham
*Attorney, Agent, or Firm*—Spencer, Frank & Schneider

[57] ABSTRACT

A dielectric filter includes a unitary dielectric block formed of a uniform, single dielectric material and having electrically conductive metallized patterns formed on front, rear and lateral walls, and on an outer bottom surface thereof. A plurality of coaxial dielectric resonators each including an open end and a central conductor are longitudinally arranged along the center of a top surface of the block and are spaced apart a predetermined distance. Frequency adjusting patterns are formed on the top surface of the block, each frequency adjusting pattern extending around an open end of a respective one of the resonators. Coupling amount adjusting patterns are also disposed on the top surface of the block, each connected to the front and rear walls and disposed between adjacent ones of the frequency adjusting patterns. At least one additional coupling amount adjusting pattern is disposed on the top surface of the block. The additional coupling amount adjusting pattern has a first end mechanically connected to the front wall and a second end capacitively coupled to the rear wall, a gap being provided between the second end and the rear wall. The additional coupling amount adjusting pattern determines a pre-adjusted maximum coupling amount larger than a coupling amount of the plurality of coupling amount adjusting patterns which are connected to the front and rear walls.

4 Claims, 15 Drawing Sheets

DIELECTRIC FILTER HAVING COUPLING AMOUNT ADJUSTING PATTERNS

CROSS-REFERENCE TO RELATED APPLICATIONS

This application is a continuation of application Ser. No. 07/655,147 (now abandoned), filed Feb. 14th, 1991, which is a continuation in part of application Ser. No. 07/366,516, filed Jun. 15th, 1989 (U.S. Pat. No. 5,015,974).

BACKGROUND OF THE INVENTION

1. Field of the Invention

The present invention relates to a dielectric filter which is preferably used in antenna duplexers for mobile telecommunications.

2. Description of the Prior Art

As conventional technique in this field, the following examples are known: Japanese patent laid-open publication No. 108302/1990 applied for in the name of the same applicant as that of the present application: and U.S. Pat. No. Re. 32,768 assigned to Motorola Inc.

FIG. 1 is a perspective view showing a first example of the conventional dielectric filter that adopts the technique of U.S. Pat. No. Re. 32,768. The filter is arranged in such a manner that one stage of a notch filter is inserted which has an attenuation pole at the lower or upper frequency band of the passband. As shown in FIG. 1, the dielectric filter has five independent blocks of dielectric material 51-1-51-5, the height of which is represented by the letter H. The dielectric blocks 51-1-51-5 have dielectric resonators 52-1-52-5 vertically embedded thereinto in a parallel fashion, each of which dielectric resonator is composed of a cylindrical central conductor. The bottom ends of the central conductors are connected to electrically conductive, metallized patterns formed on the bottom surfaces 53-1-53-5 of the dielectric blocks 51-1-51-5, respectively. The metallized patterns on the bottom surfaces are further connected to metallized patterns on the sides (hatched portions in FIG. 1) of the dielectric blocks 51-1- 51-5. In addition, at the top surfaces 54-1-54-5, the central conductors of the dielectric resonators 52-1-52-5 are soldered to conductive wires 55-1-55-5 extending to a board 56, respectively. The sides of dielectric blocks 51-1-51-5 are joined together by soldering so that they are integrally arranged as shown in FIG. 1.

The board 56 is provided so that it faces the top surfaces (open surfaces) 54-1-54-5 of the dielectric blocks 51-1-51-5. Although the bottom surface and sides of the board 56 are not metallized, the top surface (open surface) 57 is provided with conductive patterns 58-1-58-5 for adjusting coupling amounts. The coupling amount adjusting patterns 58-1-58-5 are soldered to the conductive wires 55-1-55-5, respectively. Furthermore, the top surface (open surface) 57 of the board 56 is provided with an input pattern 59-1 for receiving an input signal, and an output pattern 59-2 which is located between the coupling amount adjusting patterns 58-4 and 58-5. An input pin 60-1 and an output pin 60-2, which are made of electrically conductive wires, are soldered to the input pattern 59-1 and output pattern 59-2, respectively.

FIG. 2 shows an equivalent circuit of the first example of the conventional dielectric filter shown in FIG. 1. In FIG. 2, parallel resonance circuits ($l_{52-1}$, $C_{52-1}$), ($l_{52-2}$, $C_{52-2}$), ($l_{52-3}$, $C_{52-3}$), ($l_{52-4}$, $C_{52-4}$), ($l_{52-5}$, $C_{52-5}$) correspond to inductances and capacitances of dielectric resonators 52-1-52-5, respectively. Reference indication $C_{59-1}$ denotes a capacitance between the input pattern 59-1 and the coupling amount adjusting pattern 58-1; representation $C_{59-2}$ denotes a capacitance between the output pattern 59-2 and the coupling amount adjusting pattern 58-5; indication $C_{58-1}$ similarly denotes a capacitance between the coupling amount adjusting pattern 58-1 and the coupling amount adjusting pattern 58-2; reference indication $C_{58-2}$ denotes a capacitance between the coupling amount adjusting pattern 58-2 and the coupling amount adjusting pattern 58-3; indication $C_{58-3}$ denotes a capacitance between the coupling amount adjusting pattern 58-3 and the coupling amount adjusting pattern 58-4; and indication $C_{58-4}$ denotes a capacitance between the coupling amount adjusting pattern 58-4 and the output pattern 59-2. It is seen from FIG. 2 that the attenuation amount of the filter in the passband tends to decline as the frequency increases because the dielectric resonators are capacitively coupled, and that the notch filter circuit is composed of a series resonance circuit of $C_{59-2}$ and $L_{52-5}$. Thus the notch frequency of the notch filter circuit is the series resonant frequency of $C_{59-2}$ and $L_{52-5}$.

FIG. 3 illustrates the attenuation characteristic of the dielectric filter of the first conventional example with its notch frequency at the lower frequency band of the passband. As seen from this figure, the notch frequency at the lower frequency band of the passband enables the attenuation amount to take a large value, which in turn can reduce the number of stages of the notch filter circuit, resulting in a reduction in the size of the filter. In contrast, when the notch frequency is located at the upper frequency band of the passband, one stage of a notch filter circuit is not sufficient to achieve a desired attenuation amount because of the capacitive coupling. Therefore, the number of stages of the notch filter circuit must be increased, thereby increasing the size of the filter.

FIG. 4 is a perspective view showing a second example of a conventional dielectric filter. In FIG. 4. reference numeral 71 designates a unitarily constructed dielectric block whose width is represented by W, length is L, and height is H. On the front surface (front side) 80, back surface (back side) 81, left side 82, right side 83 and bottom surface 84 of the dielectric block 71 are formed conductive, metallized surfaces by plating, for example. On the top surface (open surface) 85 of the dielectric block 71, conductive frequency adjusting patterns 72-1-72-4 are formed between which holes 73-1-73-3 are provided. In the dielectric block 71, central conductors 74-1-74-4 which function as dielectric resonators (and hence are called dielectric resonators hereinafter) are embedded through the frequency adjusting patterns 72-1-72-4, respectively. Moreover, in the dielectric resonators 74-1-74-4, external circuits 75-1-75-4 are embedded (which are separately depicted above the dielectric block 71 in FIG. 4 for convenience of explanation). The external circuits 75-1 and 75-2 connect the dielectric resonators 74-1 and 74-2, and the external circuits 75-3 and 75-4 connect the dielectric resonators 75-3 and 75-4 so that those external circuits form portions of the attenuation poles. The external circuits 75-1-75-4 are composed of the following elements: cylindrical portions 78-1-78-4 which are made of a dielectric material such as a glass epoxy resin with a diameter of D, and are inserted into the dielectric resonators 74-1-74-4, respectively: an input pin 76-1 formed on the top surface of the cylindrical portion 78-1; coupling pins 77-1 and 77-2 formed on the top surfaces of the cylindrical portions 78-2 and 78-3, respectively: an output pin 76-2 formed on the top surface of the cylindrical portion 78-4; a conductive wire 79-1 connecting between the input pin 76-1 and the coupling pin 77-1; and an electrically conductive wire 79-2 connecting between the coupling pin 77-2 and the output pin 76-2. The diameter of the pins is represented by d (<D). The insides of the holes 73-1–73-3 are not plated by any conductive, metallized layer, 14 being only simple holes with certain diameters and depths. Those diameters and depths are varied to adjust the coupling amounts between the dielectric resonators. The holes for the dielectric resonators and the holes for adjusting the coupling amounts are formed nearly parallel.

FIG. 5 is an equivalent circuit of the dielectric filter of FIG. 4. In that equivalent circuit, the inductance of the conductive wire 79-1 connecting the input pin 76-1 and the coupling pin 77-1, and that of the conductive wire 79-2 connecting between the output pin 76-2 and the coupling pin 77-2 are neglected because they are small.

In FIG. 5, notations ($l_{74-1}$, $C_{74-1}$), ($l_{74-2}$, $C_{74-2}$), ($l_{74-3}$, $C_{74-3}$), and ($l_{74-4}$, $C_{74-4}$) designate inductances and capacitances of the dielectric resonators 74-1–74-4, respectively. Indication C71 represents the capacitance between the input pin 76-1 and the dielectric resonator 74-1, and C75 represents the capacitance between the output pin 76-2 and the dielectric resonator 74-4. Represetation $l_{72}$ denotes the inductance between the dielectric resonators 74-1 and 74-2, which is controlled by adjusting the hole 73-1, $l_{73}$ denotes the inductance between the dielectric resonators 74-2 and 74-3, which is controlled by adjusting the hole 73-2, and l74 denotes the inductance between the dielectric resonators 74-3 and 74-4, which is controlled by adjusting the hole 73-3. Reference indication $C_{77}$ represents the capacitance between the coupling pin 77-1 and the dielectric resonator 74-2, and $C_{78}$ represents the capacitance between the coupling pin 77-2 and the dielectric resonator 74-3. The equivalent circuit shows that the attenuation poles $ft_{\infty}$ exist in the upper frequency band of the passband. The attenuation poles $ft_{\infty}$ can be expressed as $$1/2\pi\sqrt{C_{77}(l_{74-1}+l_{72})}\text{, and}$$

$$1/2\pi\sqrt{C_{78}(l_{74-4}+l_{75})}\,.$$

FIG. 6 illustrates the attenuation characteristic of the second example of a conventional dielectric filter. This figure shows that the attenuation pole frequency $ft_{\infty}$ exists at the upper frequency band of the passband. This type of dielectric filter has the following two problems arising from using the holes for adjusting the coupling between the dielectric resonators: one is that its size cannot be made small; and the other is that the coupling adjustment is difficult.

In short, the conventional dielectric filters present the following problems: The first type of dielectric filter which uses the notch filter to form the attenuation pole frequency at the lower frequency band of the passband has the problem that its size cannot be made small because one stage of a notch filter provides only insufficient attenuation, and hence an increasing number of stages of the notch filter must be provided.

The second type of dielectric filter which uses the holes to form the attenuation pole frequency at the upper frequency band of the passband has the problem that the adjustment of the coupling amounts is difficult and takes a time, in addition to the fact that its size cannot be made small. This is because the holes of more than a certain limited diameter are required, and the coupling amounts must be adjusted by changing positions, diameters, and depths of the holes.

SUMMARY OF THE INVENTION

It is therefore an object of the present invention to provide a dielectric filter having a sufficient attenuation amount without increasing the number of stages of the dielectric resonators can easily achieved, and the adjustment of the filter can be facilitated.

According to the present invention, there is provided a dielectric filter having a dielectric block including a uniform, single dielectric material, and a plurality of dielectric resonators each of which includes a central conductor formed in the dielectric block in an approximately parallel fashion, the dielectric filter comprising: at least one coupling amount adjusting patterns each of which is formed on the top surface of the dielectric block between the two adjacent dielectric resonators and is grounded so that the dielectric resonators are coupled through inductive impedance.

Also in accordance with the present invention, a dielectric filter has coupling amount adjusting patterns each of which is formed between two adjacent dielectric resonators and is grounded. This enables the dielectric resonators to be coupled through inductive impedances, which makes the attenuation amount in the upper frequency band of the passband greater than that in the lower frequency band of the passband. Thus, a dielectric filter of a desired frequency characteristic can be achieved with a small number of stages of the dielectric resonators. In addition, the inductive impedance coupling accomplished by the coupling amount adjusting patterns enable not only the distances between the dielectric resonators to be shortened, thereby reducing the required space, but also the coupling adjustment are carried out more easily, thereby shortening the time required for adjusting the filter in its manufacturing process.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
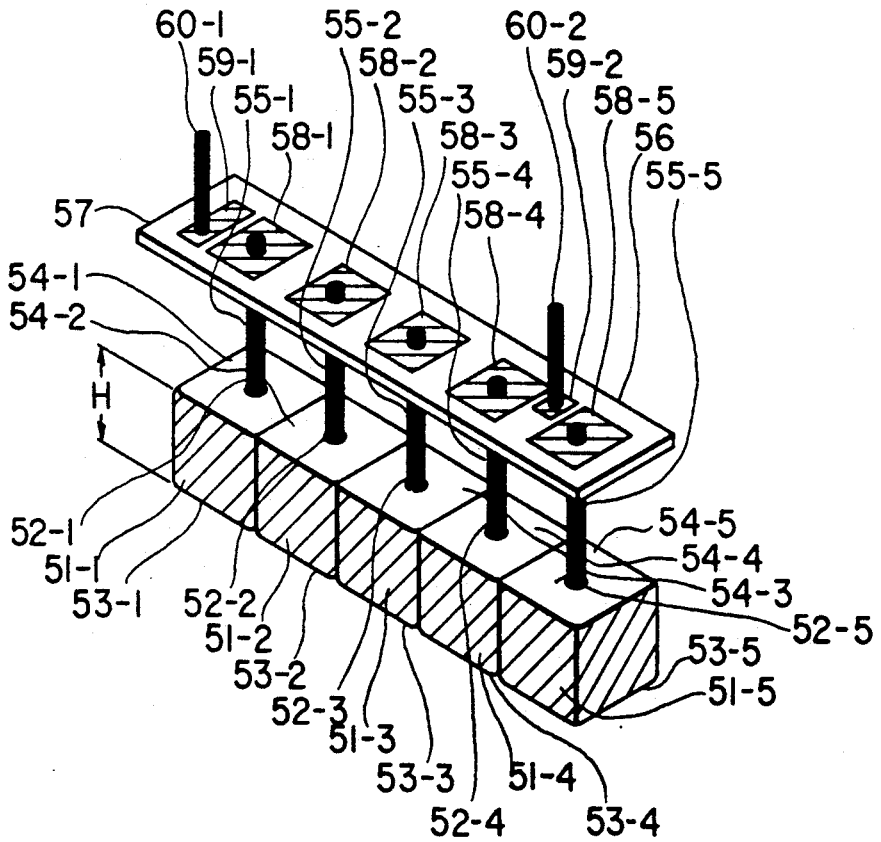
FIG. 1 PRIOR ART
FIG. 1 is a perspective view showing an example of conventional dielectric filters.
Figure 2:
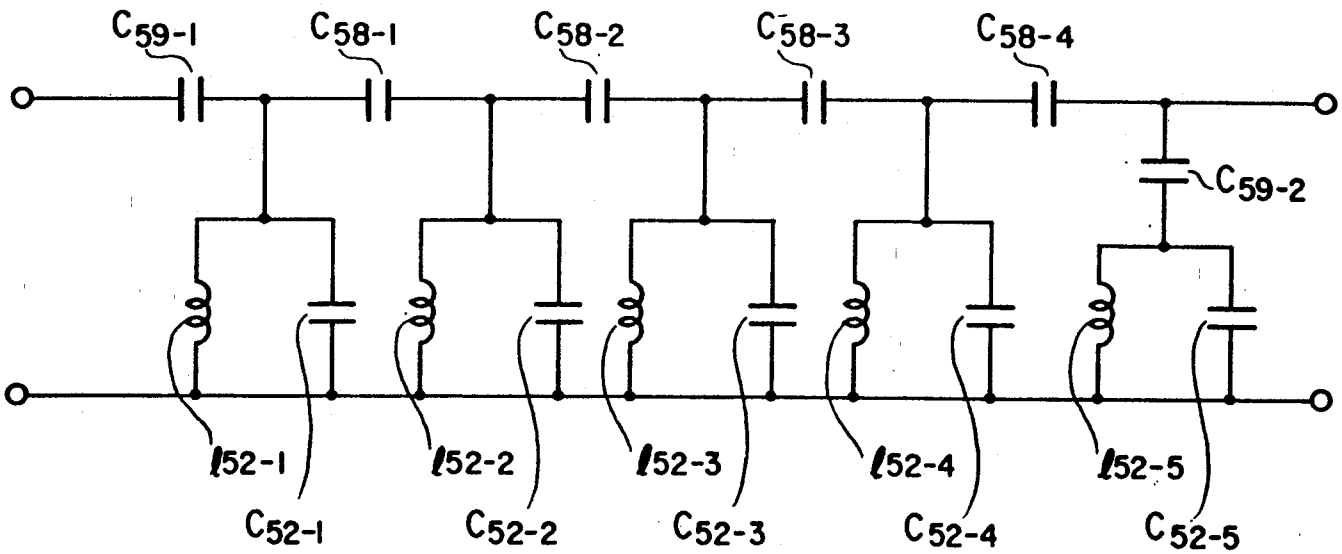
FIG.2 PRIOR ART
FIG. 2 is a circuit diagram showing an equivalent circuit of the example of a conventional dielectric filter of FIG. 1.
Figure 3:
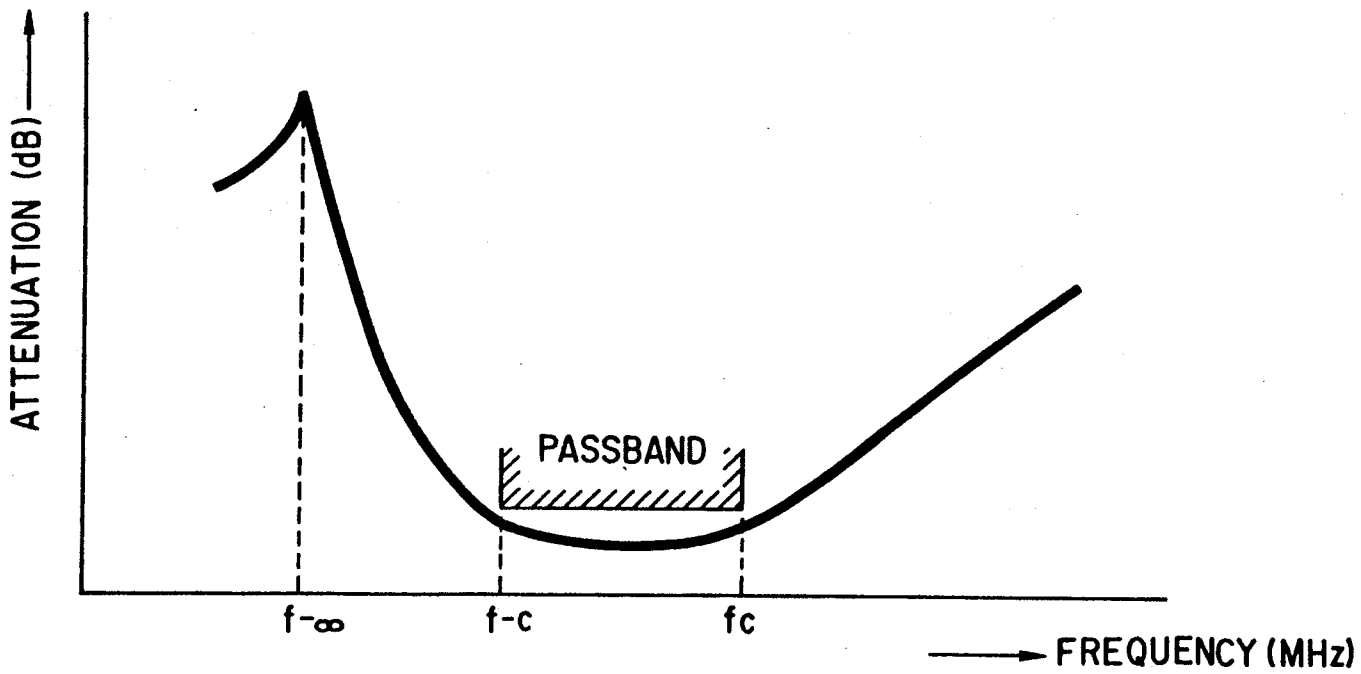
FIG.3 PRIOR ART
FIG. 3 is a diagram in which is plotted the attenuation characteristic of the conventional dielectric filter of the example shown in FIG. 1.
Figure 4:
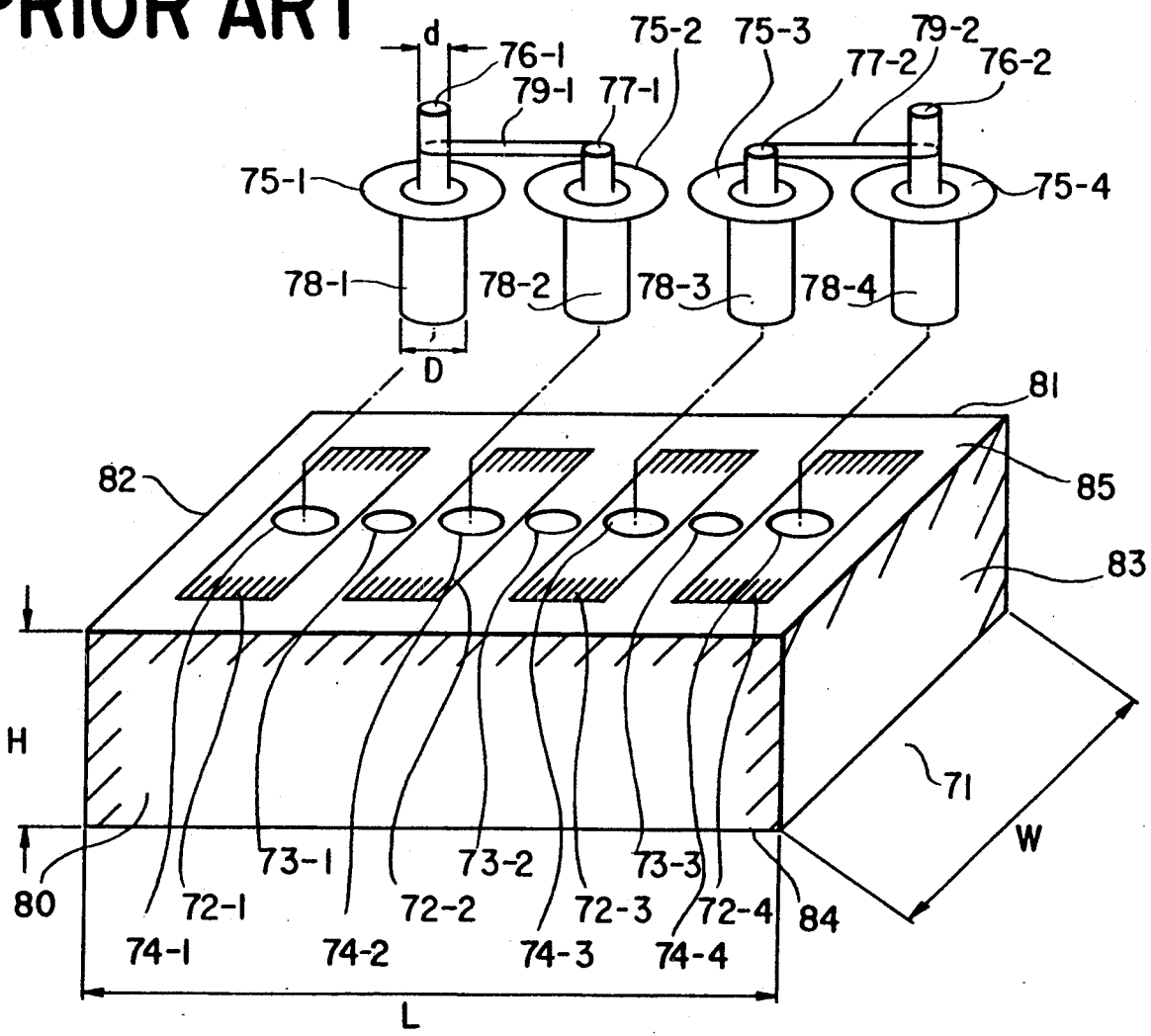
FIG.4 PRIOR ART
FIG. 4 is a perspective view showing another example of a conventional dielectric filter.
Figure 5:
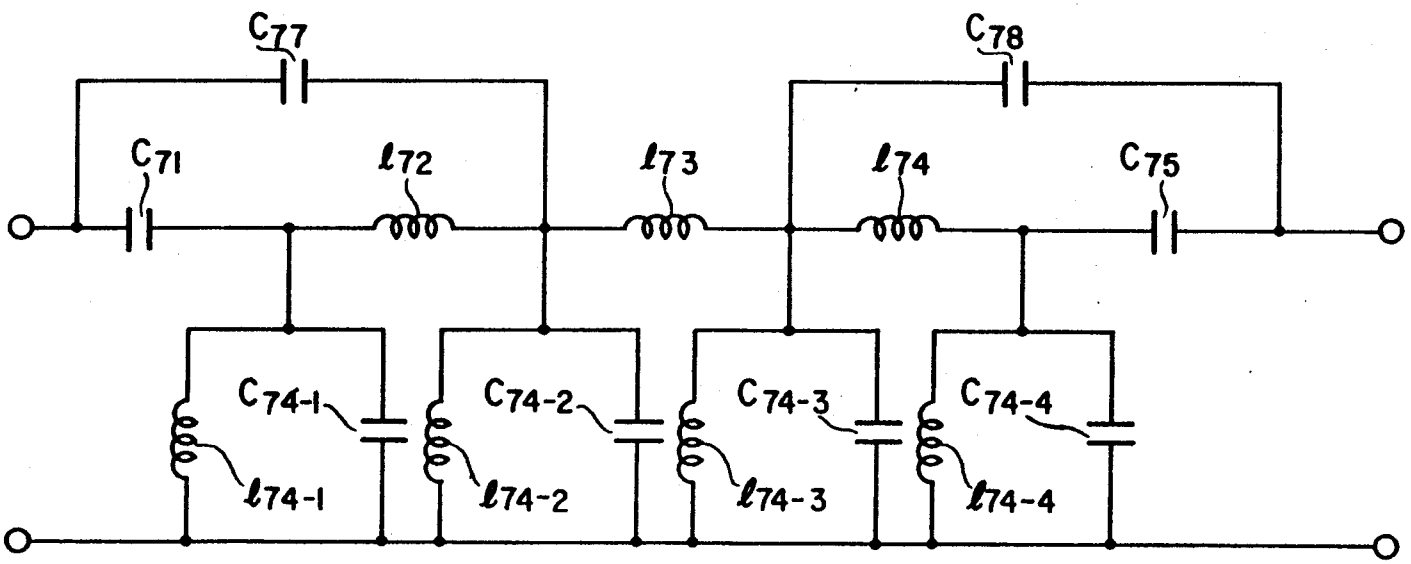
FIG.5 PRIOR ART
FIG. 5 is a circuit diagram showing an equivalent circuit of the other example of a conventional dielectric filter of FIG. 4.
Figure 6:
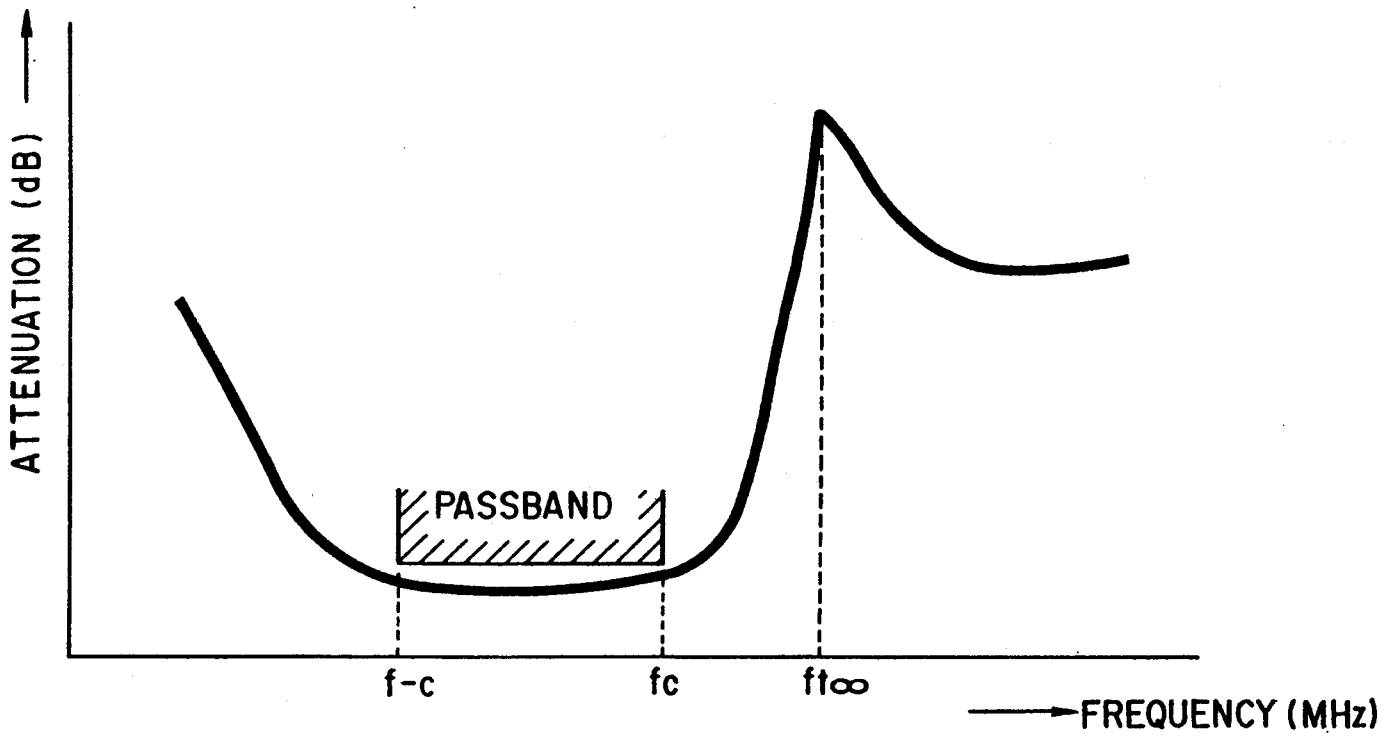
FIG.6 PRIOR ART
FIG. 6 is a diagram in which the attenuation characteristic is plotted of for the conventional dielectric filter of the other example shown in FIG. 4.
Figure 7:
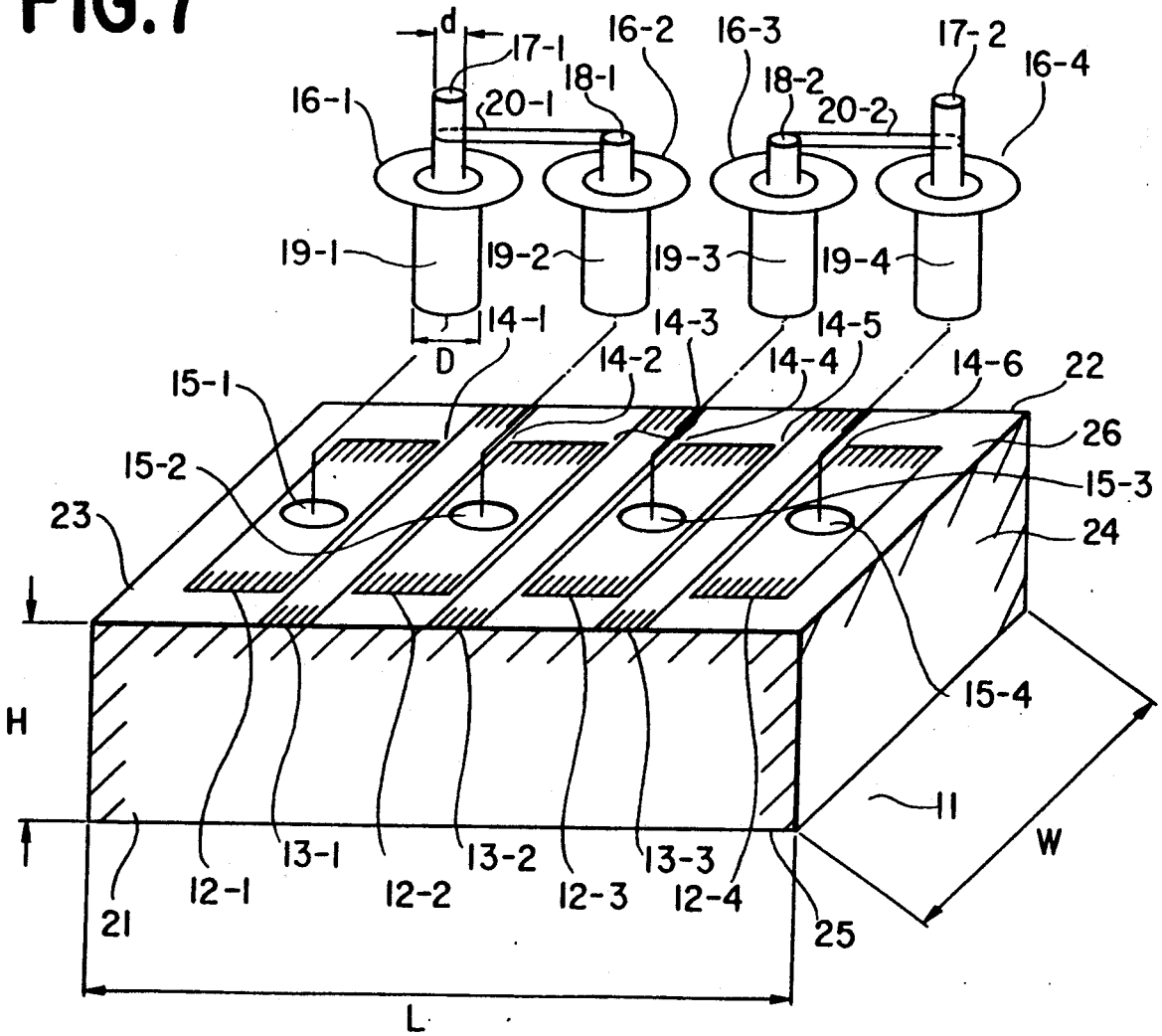
FIG. 7 is a perspective view showing an embodiment of a polarized type of dielectric filter according to the present invention.

FIG. 7 is a perspective view showing an illustrative embodiment of a polarized type of dielectric filter according to the present invention. In FIG. 7, reference numeral 11 designates a unitarily constructed dielectric block made of a dielectric material such as a ceramic with the width of W, length of L, and height of H. Typical values of W, L and H are, for example, 4.3 mm, 16.0 mm and 9.0 mm, respectively. On the front surface (front side) 21, back surface (back side) 22, left side 23, right side 24, and bottom surface 25 of the dielectric block 11 are formed electrically conductive, metallized layers by plating, for example, as shown by hatches in this figure.

On the top surface (open surface) 26 of the dielectric block 11, are also formed electrically conductive, frequency adjusting patterns 12-1–12-4, and coupling amount adjusting patterns 13-1–13-3 with gaps 14-1–14-6. In the dielectric block 11, central conductors 15-1–15-4 which function as dielectric resonators (and hence are called dielectric resonators hereinafter) are embedded through the frequency adjusting patterns 12-1–12-4, respectively. Moreover, in the dielectric resonators 15-1–15-4 are inserted and embedded external circuits 16-1–16-4 (which are separately depicted above the dielectric block 11 in FIG. 7 for convenience of explanation).

The external circuits 16-1 and 16-2 connect the dielectric resonators 15-1 and 15-2, and the external circuits 16-3 and 16-4 connects the dielectric resonators 15-3 and 15-4 so that the external circuits form the attenuation poles. The external circuits 16-1–16-4 are composed of the following elements: cylindrical portions 19-1–19-4 which are made of a dielectric material such as a glass epoxy resin with a diameter of D, and are inserted into the dielectric resonators 15-1–15-4, respectively; an electrically conductive input coupling pin 17-1 formed on the top surface of the cylindrical portion 19-1; coupling pins 18-1 and 18-2 formed on the top surfaces of the cylindrical portions 19-2 and 19-3, respectively; an output coupling pin 17-2 formed on the top surface of the cylindrical portion 19-4; an electrically conductive wire 20-1 connecting between the input coupling pin 17-1 and the coupling pin 18-1; and an also electrically conductive wire 20-2 connecting between the coupling pin 18-2 and the output coupling pin 17-2. The diameter of the pins is represented by d (<D) in the figure.

Respective first ends of the coupling amount adjusting patterns 13-1–13-3 are connected to the front surface (front side) 21 of the dielectric block 11, and the other ends thereof are connected to the metallized pattern on the back surface (back side) 22 of the dielectric block 11. The coupling adjusting patterns 13-1–13-3 function as electrodes for adjusting the coupling amount: the coupling adjusting pattern 13-1 is provided for adjusting the inductive impedance coupling between the frequency adjusting patterns 12-1 and 12-2; the coupling adjusting pattern 13-2 is for adjusting the inductive impedance coupling between the frequency adjusting patterns 12-2 and 12-3; and the coupling adjusting pattern 13-1 is provided for adjusting the inductive impedance coupling between the frequency adjusting patterns 12-3 and 12-4.

In operation, applying an electric microwave signal with a frequenc y of 800–880 MHz from an external apparatus to the input coupling pin 17-1 and then to the dielectric resonators 15-1 and 15-2 induces an electromagnetic field around the resonators 15-1 and 15-2. The electromagnetic field around the dielectric resonator 15-2 is propagated to the adjacent dielectric resonator 15-3 through the gap 14-3, coupling amount adjusting pattern 13-2, gap 14-4 and the frequency adjusting pattern 12-3, thus inducing electromagnetic field around the dielectric resonator 15-3.

After that, the electromagnetic field around the dielectric resonator 15-3 is propagated through the gap 14-5, coupling amount adjusting pattern 13-3, gap 14-6, and the frequency adjusting pattern 12-4, to the dielectric resonator 15-4, and then to the external circuit 16-4. The electric signal in the form of the electromagnetic field from the dielectric resonator 15-3 is also propagated to the dielectric resonator 15-4 and the external circuit 16-4 by way of external circuit 16-3 and the conductive wire 20-2. The output coupling pin 17-2 of the external circuit 16-4 is connected to a load not shown in this figure, and hence the electric signal applied to the input coupling pin 17-1 is finally propagated to the load via the output coupling pin 17-2.

Figure 8:
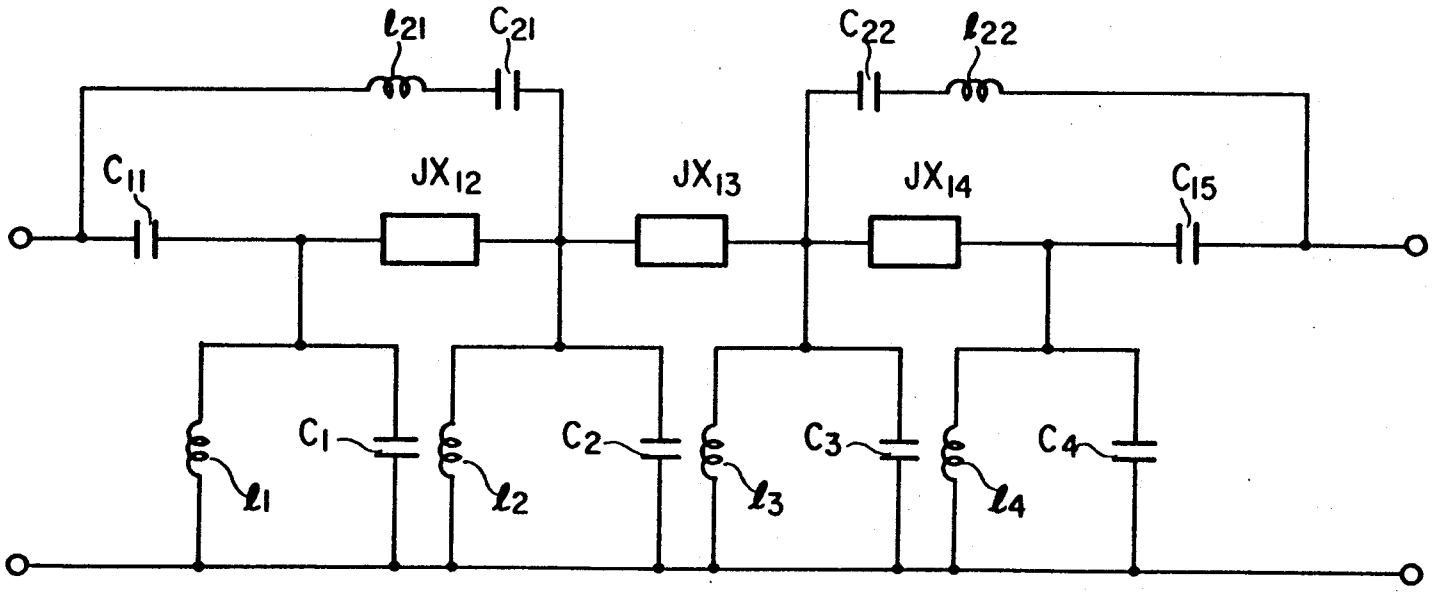
FIGS. 8 and 9 are circuit diagrams showing equivalent circuits of the embodiment shown in FIG. 7.

FIG. 8 is an equivalent circuit of the polarized type of dielectric filter of the illustrative embodiment of the present invention. In FIG. 8, reference indication l1 denotes the inductance of the dielectric resonator 15-1 and indication Cl denotes the capacitance of the dielectric resonator 15-1. Likewise, reference l2 denotes the inductance of the dielectric resonator 15-2 and reference C2 denotes the capacitance of the dielectric resonator 15-2; indication l3 denotes the inductance of the dielectric resonator 15-3 and indication C3 denotes the capacitance of the dielectric resonator 15-3; and indication l4 denotes the inductance of the dielectric resonator 15-4 and notation C4 denotes the capacitance of the dielectric resonator 15-4.

Reference indication C11 indicates the capacitance between the input coupling pin 17-1 and the dielectric resonator 15-1, and indication C15 indicates the capacitance between the output coupling pin 17-2 and the dielectric resonator 15-4. A box jX12 represents the inductive impedance between the dielectric resonator 15-1 and the dielectric resonator 15-2. Likewise, box jX13 is the inductive impedance between the dielectric resonator 15-2 and the dielectric resonator 15-3; and box jX14 is the inductive impedance between the dielectric resonators 15-3 and 15-4.

Representation C21 indicates the capacitance between the coupling pin 18-1 and the dielectric resonator 15-2, and indication C22 indicates the capacitance between the coupling pin 18-2 and the dielectric resonator 15-3. Notation l21 denotes the inductance of the conductive wire 20-1 connecting the input pin 17-1 and the coupling pin 18-1, and l22 denotes the inductance of the conductive wire 20-2 connecting the coupling pin 18-2 and the output pin 17-2.

Figure 9:
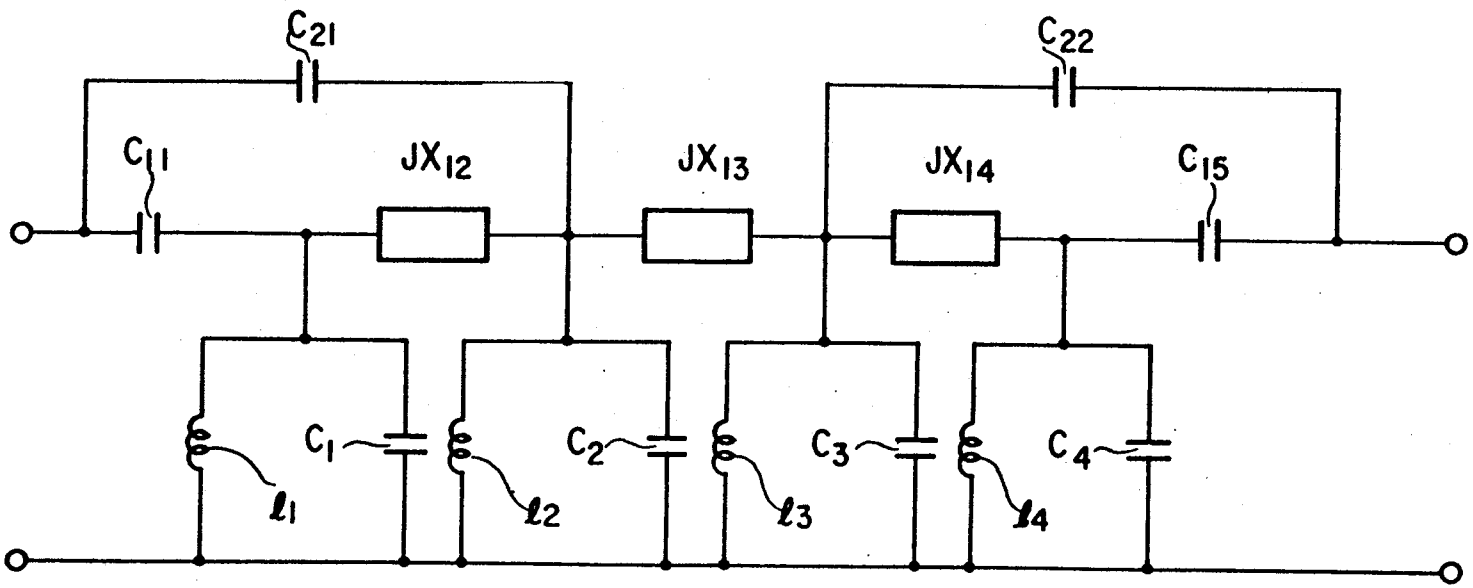

In general, since the values l21 and C21, and l22 and C22 are specified to satisfy the conditions:

$$|\omega l21| << |1/\omega C21| \text{ and}$$

$$|\omega l22| << |1/\omega C22|,$$

the values l21 and l22 can be neglected. In this case, the equivalent circuit can be depicted as shown in FIG. 9. The attenuation pole frequency $f\infty$ satisfies the relation $$f\infty > f0,$$

where f0 denotes the central frequency of the passband. This means that the pole frequency $f\infty$ is located in the upper frequency band of the passband.

In this embodiment, the attenuation amount becomes infinite at the attenuation pole frequencies expressed by $$f\infty 1 = 1/2\pi\sqrt{C21(l1 + X12)} \text{ and}$$

$$f\infty 2 = 1/2\pi\sqrt{C22(l4 + X14)}.$$

Figure 10:
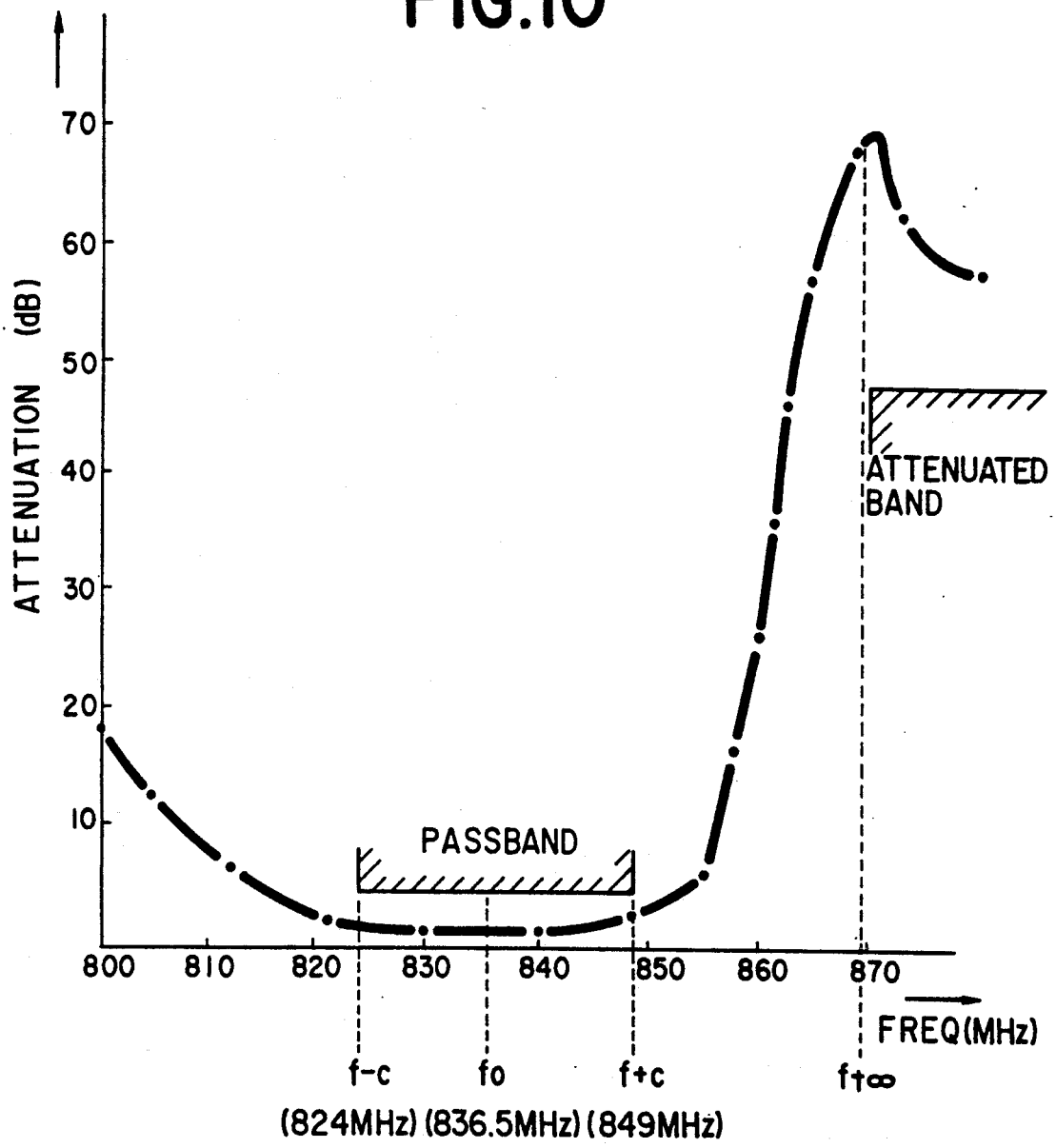
FIG. 10 is a diagram illustrating the attenuation characteristic of the polarized type of dielectric filter of the embodiment in FIG. 7.

FIG. 10 plots the attenuation characteristic of the polarized type of dielectric filter of the illustrative embodiment of the present invention. In this figure, the x-axis represents the frequency (MHz) and the y-axis represents the attenuation amount (dB). As clearly seen from this figure, the polarized type of dielectric filter of FIG. 7 has an attenuation pole at a higher frequency than the passband, that is, in the upper frequency band of the passband.

Figure 11:
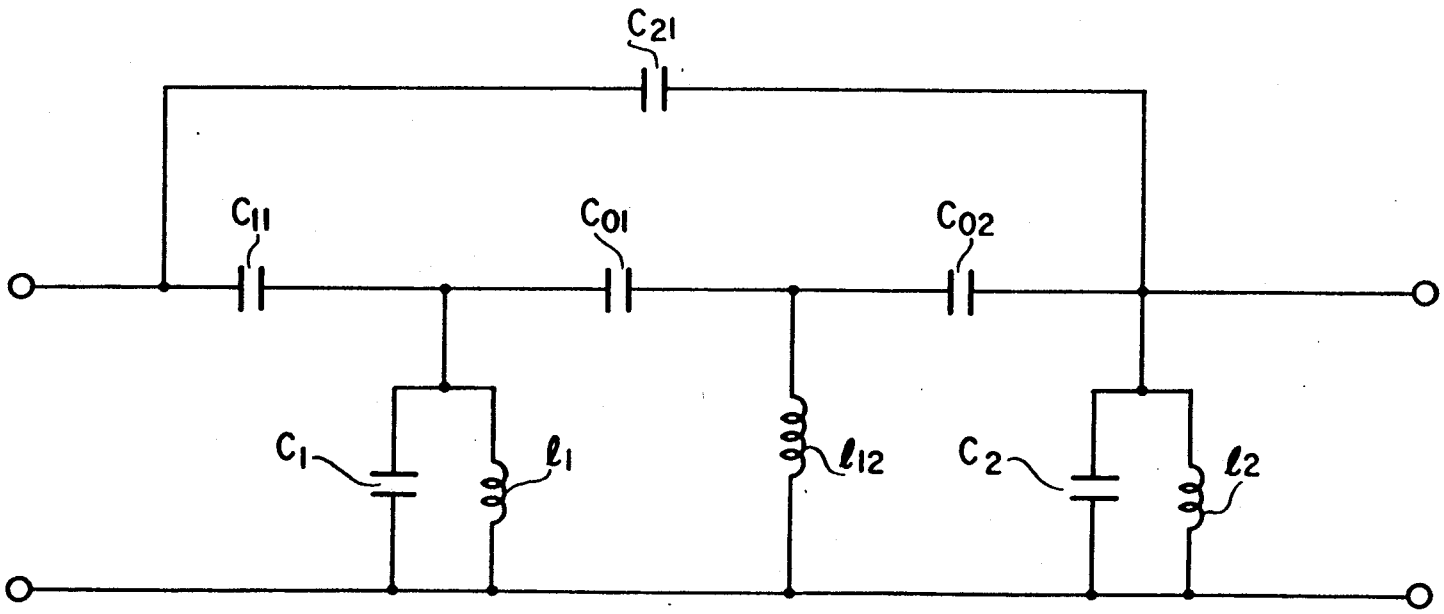
FIG. 11 is a circuit diagram showing an equivalent circuit between two of the dielectric resonators shown in FIG. 7.

FIG. 11 illustrates an equivalent circuit between the dielectric resonators 15-1 and 15-2 of FIG. 7. In this figure, box jX12 of FIG. 9 corresponds to the part designated by C01, C02 and l12. Here, expression C01 is directed to the capacitance between the frequency adjusting pattern 12-1 of the dielectric resonator 15-1 and the coupling amount adjusting pattern 13-1; indication CO2 denotes the capacitance between the coupling amount adjusting pattern 13-1 and the frequency adjusting pattern 12-2 of the dielectric resonator 15-2; and reference indication l12 designates the equivalent inductance of the inductive impedance of the coupling amount adjusting pattern 13-1.

Figure 12:
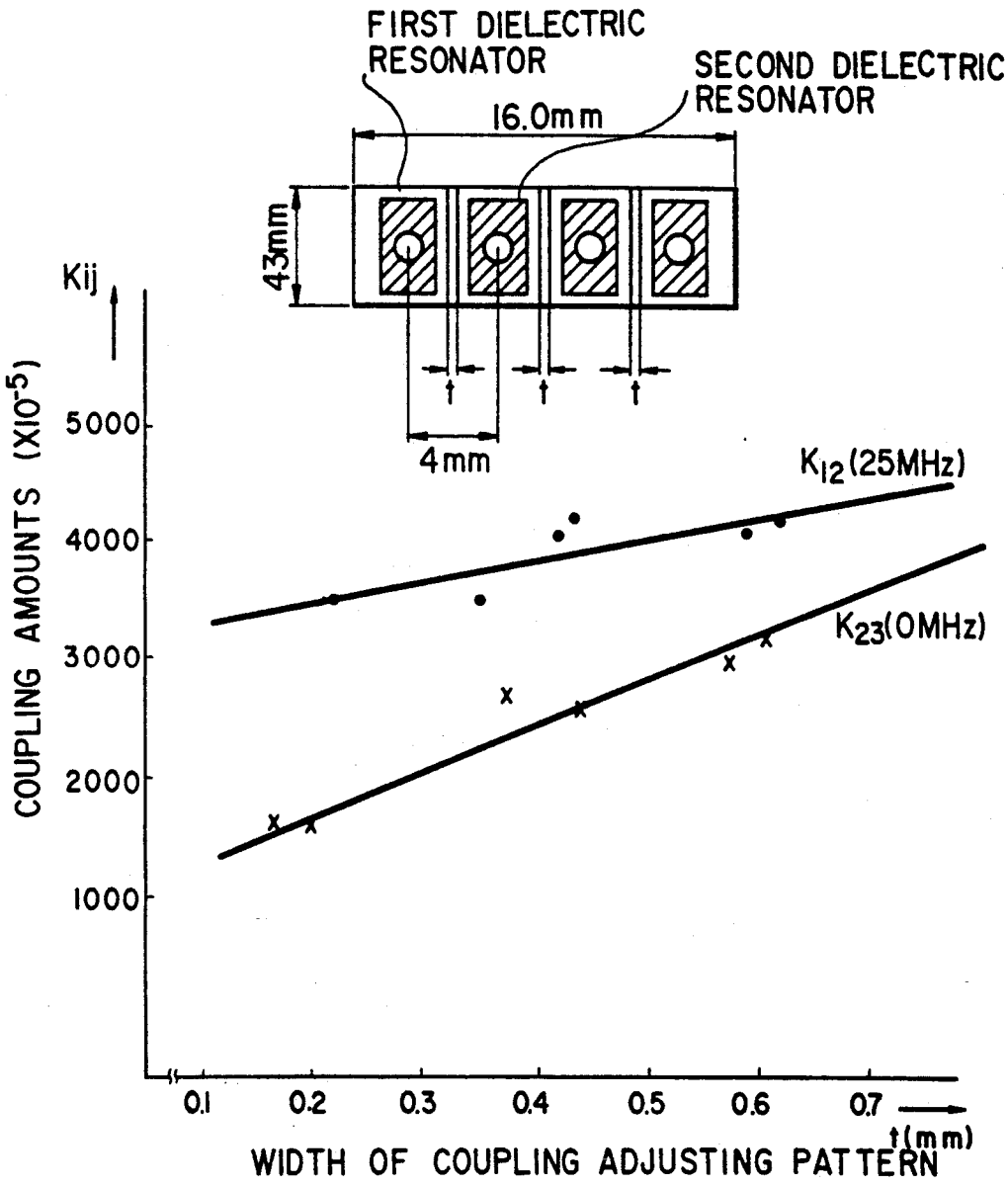
FIG. 12 is a graph in which the characteristics of the coupling amount between the first and second dielectric resonators are plotted with respect to the width of the coupling amount adjusting pattern.

An experiment was carried out in which the coupling amounts between the two adjacent dielectric resonators were measured by varying the width t of the coupling amount adjusting patten. The center-to-center distance between the two dielectric resonators was 4 mm; the width W of the dielectric block 11 was 4.3 mm, the length L was 16 mm, and the height H was 9 mm with the embodiment shown in FIG. 7. FIG. 12 plots the coupling amounts obtained as the results of the experiment. As seen from this figure, as the width t of the coupling adjusting pattern becomes narrower, the coupling amounts become smaller. Here, the contents in the parentheses following characters K12 and K23 in FIG. 12 designate the differences between the resonance frequencies of the two dielectric resonators. The difference arises from the increase of the l12 of FIG. 12. The coupling amount can also be varied by changing values CO1 and CO2 in FIG. 11. This corresponds to changing the gap 14-1 between the frequency adjusting pattern 12-1 and the coupling amount adjusting pattern 13-1, and the gap 14-2 between the frequency adjusting pattern 12-2 and the coupling amount adjusting pattern 13-1.

As described above, the present invention is provided with the coupling amount adjusting patterns 13-1–13-3 formed on the top surface (open surface) 26 of the dielectric block 11 to achieve the inductive impedances. This enables the filter to be made smaller than the conventional filters with adjusting holes. Furthermore, since the coupling amount adjusting patterns are formed on the top surface (open surface) of the dielectric block, the widths of the coupling amount adjusting patterns can be easily controlled by laser trimming or similar trimming methods, which will facilitate the adjustment of the filter characteristics.

Figure 13:
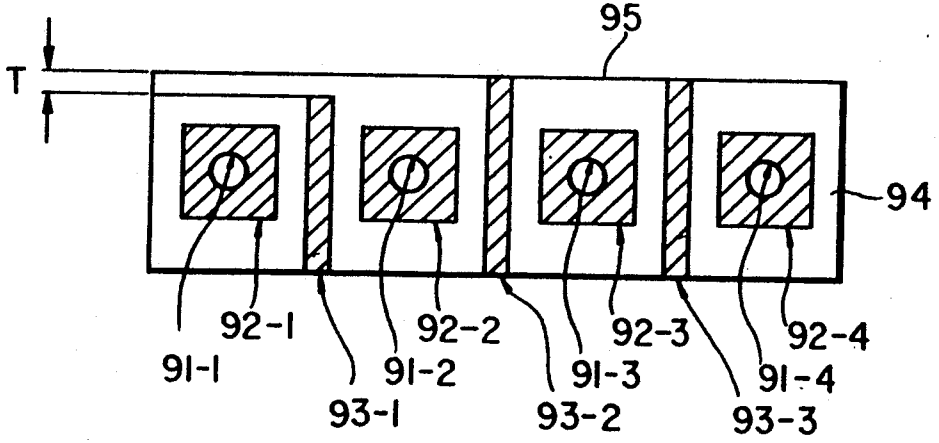
FIG. 13 is a plan view showing an alternative embodiment of the present invention which is resultant from altering the top pattern of the embodiment of FIG. 7.

FIG. 13 is a plan view of an alternative embodiment of the present invention which is resultant from changing the top pattern of the embodiment shown in FIG. 7. The top pattern of FIG. 7 corresponds to that of FIG. 13 when gap T is made zero in FIG. 13.

Figure 15:
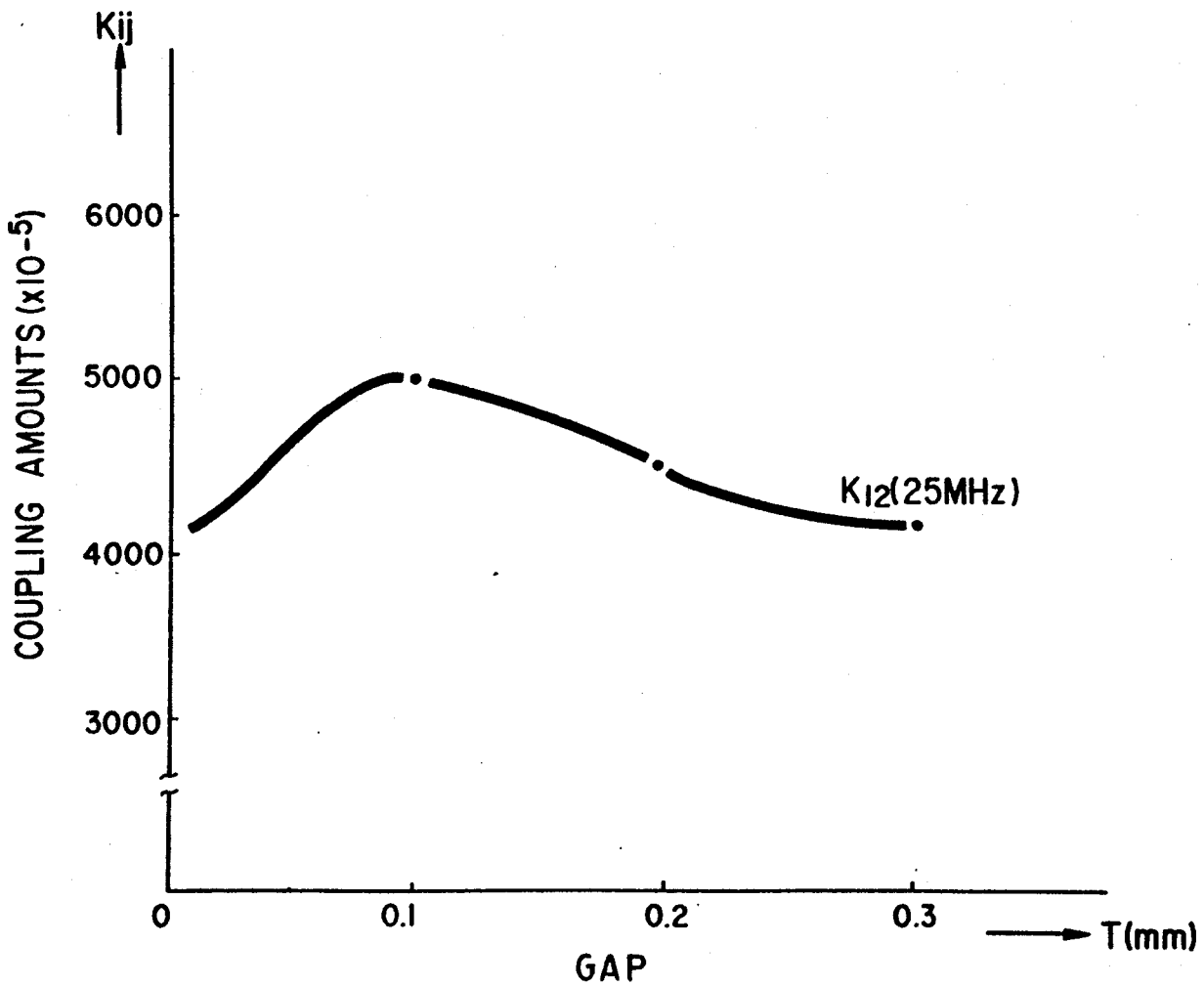
FIG. 15 is a graph in which the characteristics of two amount between the couple of the dielectric resonators are plotted with respect to the gap shown in FIG. 13.

An experiment was carried out in which the coupling amounts between the two adjacent dielectric resonators 91-1 and 91-2 were measured by varying the gap T of the coupling amount adjusting pattern 93-1. The center-to-center distance between the two adjacent dielectric resonators was 4 mm; the width W of the dielectric block 11 was 4.3 mm, the length L was 16 mm, and the height H was 9 mm in the embodiment. FIG. 15 plots the coupling amounts obtained as the results of the experiment. As seen from this figure, the coupling amount can be increased by about 20% by making T nonzero.

Figure 14:
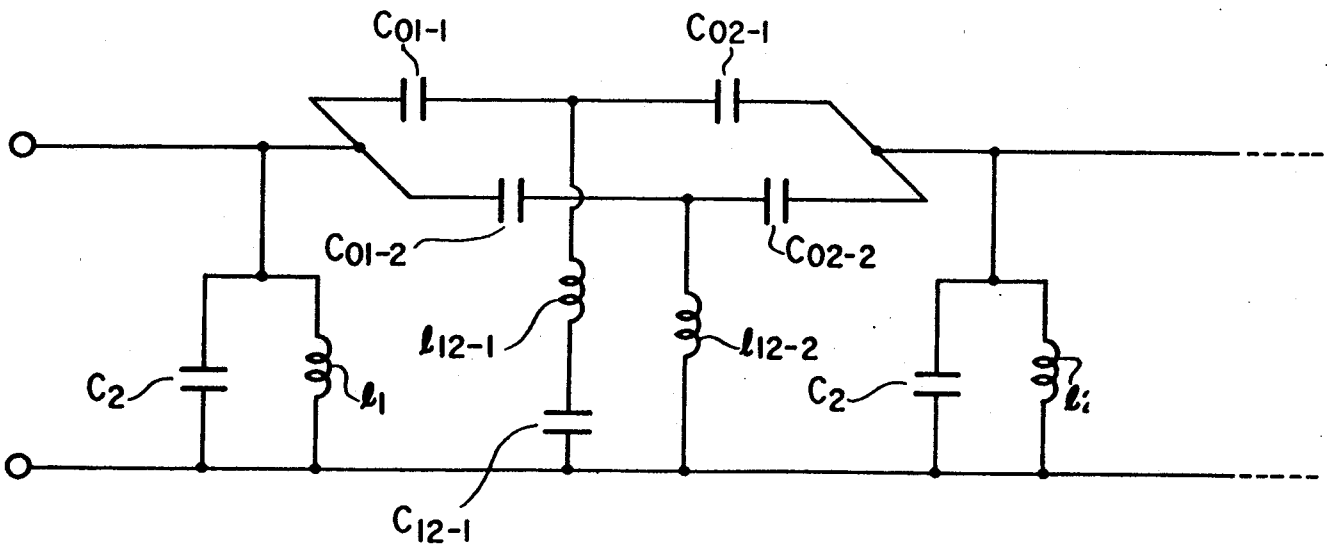
FIG. 14 is a circuit diagram showing an equivalent circuit between the dielectric resonators included in FIG. 13.

FIG. 14 illustrates an equivalent circuit between the dielectric resonators 91-1 and 91-2 of FIG. 13. FIG. 14 indicates the existence of a capacitance $C_{12\text{-}1}$ between the coupling amount adjusting pattern 93-1 and the metallized pattern formed on the back surface (back side) 22 of the dielectric block 11. This capacitance $C_{12\text{-}1}$ makes the composite impedance $l_{12\text{-}1}$ and $C_{12\text{-}1}$ smaller than when capacitance $C_{12\text{-}1}$ does not exist, thereby increasing the coupling amount.

When the method of FIG. 12 of the earlier-mentioned embodiment is used to achieve a larger coupling amount of the filter, the width of the coupling amount adjusting pattern may advantageously be made wider. This imposes a limit on reducing the size of the filter. The method in accordance with the second embodiment as shown in FIG. 15, however, enables the coupling amount to increase by 20% by making T nonzero. This achieves a small filter having a larger coupling amount.

In the above, described are embodiments a polarized type of dielectric filter. As another alternative embodiment of the present invention, a non-polarized type of dielectric filter, although not shown in drawings, is also possible by removing, for example, the external circuits 16-2 and 16-3 of the structure shown in FIG. 7. In this case, since the dielectric resonators are coupled by the inductive impedances, the attenuation amount in the upper frequency band of the passband can be made larger than that of the conventional filters using capacitive coupling.

Furthermore, still another alternative embodiment of the present invention, although not shown in the drawings, is directed to dielectric filters in which metallized layers on the sides of the dielectric block 11 of FIG. 7 are extended to the top surface of the block 11 except for areas surrounding the top surfaces of the central conductors of the dielectric resonators.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A dielectric filter comprising:

a dielectric block comprised of a dielectric material and having top, bottom and side surfaces, said bottom and side surfaces of said dielectric block being substantially covered with a first conductive material;

a plurality of holes extending from said top surface of said dielectric block towards said bottom surface thereof, each hole having a surface substantially covered with a second conductive material connected with said first conductive material at said bottom surface of said dielectric block;

conductive frequency adjusting patterns disposed on said top surface of said dielectric block which substantially surround each of said holes and connected with said second conductive material; and at least one coupling amount adjusting pattern disposed on said top surface of said dielectric block between adjacent ones of said holes and having first and second ends, the first end of said coupling amount adjusting pattern being connected to said first conductive material of a first one of said side surfaces, the second end of said coupling amount adjusting pattern being separated by a gap from said first conductive material of a side surface opposite said first one of said side surfaces;

whereby the amount of coupling between adjacent holes is adjustable to obtain a desired coupling amount at a characteristic curve by varying said gap separating said coupling amount adjusting pattern from said first conductive material of said side surface opposite said first one of said side surfaces.

2. A method of filter manufacture comprising the steps of:

forming a dielectric block comprised of a dielectric material and having top, bottom and side surfaces, said bottom and side surfaces of said dielectric block being substantially covered with a first conductive material;

forming a plurality of holes extending from said top surface of said dielectric block towards said bottom surface thereof, each hole having a surface substantially covered with a second conductive material connected with said first conductive material at said bottom surface of said dielectric block;

forming conductive frequency adjusting patterns on said top surface of said dielectric block which substantially surround each of said holes and are connected with said second conductive material;

forming at least one coupling amount adjusting pattern on said top surface of said dielectric block between adjacent ones of said holes, said at least one coupling amount adjusting pattern having first and second ends, the first end of said at least one coupling amount adjusting pattern being connected to said first conductive material of a first one of said side surfaces, the second end of said at least one coupling amount adjusting pattern being separated by a gap from said first conductive material of a side surface opposite said first one of said side surfaces; and trimming said second end of said at least one coupling amount adjusting pattern to vary said gap separating said at least one coupling amount adjusting pattern from said first conductive material of said side surface opposite said first one of said side surfaces, thereby adjusting the amount of coupling between adjacent holes to obtain a desired coupling amount on a characteristic curve defining the amount of coupling.

3. The filter according to claim 1, wherein said characteristic curve is a generally quadratic curve.

4. The method of filter manufacture according to claim 2, wherein said characteristic curve is a generally quadratic curve.

* * * * *